US009155171B1

(12) United States Patent
Hughes et al.

(10) Patent No.: US 9,155,171 B1
(45) Date of Patent: Oct. 6, 2015

(54) POWER OVER ETHERNET LIGHTING SYSTEM

(71) Applicants: David Anthony Hughes, Los Altos, CA (US); Michael Raymond Hughes, Auckland (NZ)

(72) Inventors: David Anthony Hughes, Los Altos, CA (US); Michael Raymond Hughes, Auckland (NZ)

( * ) Notice: Subject to any disclaimer, the term of this patent is extended or adjusted under 35 U.S.C. 154(b) by 231 days.

(21) Appl. No.: 13/917,398

(22) Filed: Jun. 13, 2013

(51) Int. Cl.
*H05B 37/02* (2006.01)

(52) U.S. Cl.
CPC ..... *H05B 37/0263* (2013.01); *H05B 37/02* (2013.01); *H05B 37/0227* (2013.01); *H05B 37/0254* (2013.01)

(58) Field of Classification Search
CPC ..... H05B 37/0263; H05B 37/02; H05B 37/0209; H05B 37/0218; H05B 37/0227; H05B 37/0236; H05B 37/0245; H05B 37/0254; H05B 37/0272; H05B 37/0281; H05B 33/0806; H05B 33/0803; H05B 33/0833; H05B 33/0842; H05B 33/0845; H05B 33/0884
See application file for complete search history.

(56) References Cited

U.S. PATENT DOCUMENTS

| | | | | |
|---|---|---|---|---|
| 2008/0197790 | A1* | 8/2008 | Mangiaracina et al. | 315/312 |
| 2009/0063874 | A1* | 3/2009 | Diab | 713/300 |
| 2011/0307112 | A1* | 12/2011 | Barrilleaux | 700/291 |
| 2012/0284538 | A1* | 11/2012 | Linne et al. | 713/300 |
| 2013/0119892 | A1* | 5/2013 | Feri et al. | 315/293 |
| 2013/0151025 | A1* | 6/2013 | Wendt et al. | 700/295 |

* cited by examiner

*Primary Examiner* — Jung Kim
(74) *Attorney, Agent, or Firm* — Carr & Ferrell LLP

(57) ABSTRACT

A system, method, and computer program for deploying a lighting system throughout a building using power over Ethernet is provided. In exemplary embodiments, one or more LED lighting structures may be powered using Ethernet cable in a building, and may be controlled by a distributed management system throughout a communication network.

20 Claims, 9 Drawing Sheets

POWER OVER ETHERNET LIGHTING SYSTEM

BACKGROUND

1. Field of the Invention

The present invention is generally related to systems and methods for a building lighting system that is powered using Power over Ethernet.

2. Related Art

Presently, many buildings have complicated electrical wiring systems that are installed when the building is first built. These wiring systems are typically required to be installed by a certified electrician, and the placement of overhead lighting and electrical outlets is predetermined by the wiring system that is pre-installed in the building. After the building is built, adding or moving light fixtures may be complicated and costly, requiring substantial re-wiring by an electrician.

Each light in a building may also be connected to a light switch module that is used for turning it on and off. The placement of this switch is also pre-determined by the electrical wiring system when the building is first built. Moving the placement of the light switch modules, or altering the control of the switch later typically also requires an electrician to re-wire the relevant portion of the house, which can be very complicated and costly.

These existing electrical distribution systems are typically high voltage (100-250V) AC (alternating current). Newer lighting technologies, like LED (light-emitting diode) lights, are more efficient than incandescent and even fluorescent lighting. However, they are inherently low voltage DC (direct current) driven devices. Adapting these devices to work in an existing AC distribution system requires conversion of the power sources, resulting in additional costs and complications.

Furthermore, existing light dimming schemes developed for AC powered incandescent bulbs do not work well by simply replacing the incandescent bulb with an LED light. Common dimming problems associated with using existing light dimming schemes with LED lights include flickering and flashing of the LED lights at low lighting levels, and an inability to dim below 10% of maximum lighting level.

Power over Ethernet, or PoE, is a standardized system to pass direct current (DC) electrical power along with data on Ethernet cabling. It allows a single cable to provide both a data connection and electrical power. It has typically been used to power devices requiring a small amount of energy, such as a phone or small camera. Unlike other standards such as universal serial bus (USB) which also power devices over data cables, PoE allows long cable lengths. However, PoE systems have not been previously used to power traditional lighting systems in a building.

SUMMARY

The technology disclosed herein describes a light control structure that includes a power drive unit that receives power through an Ethernet cable to power one or more lights, and a processing unit that receives packets from the Ethernet cable. The processing unit is in communication with the power drive unit. The power drive unit and the processing unit cooperate to control the light characteristics of the one or more lights.

The light control structure may further include a splitter module to provide at least one of power and data connectivity to a plurality of other devices. The structure may also include at least one wireless access point in communication with the processing unit through the communications network, and one or more sensors in communication with the processing unit. The one or more sensors in communication with the processing unit may be internal or external to the light control structure.

BRIEF DESCRIPTION OF THE DRAWINGS

Embodiments are illustrated by way of example, and not by limitation in the figures of the accompanying drawings, in which like references indicate similar elements and in which.

DETAILED DESCRIPTION

Figure 1:
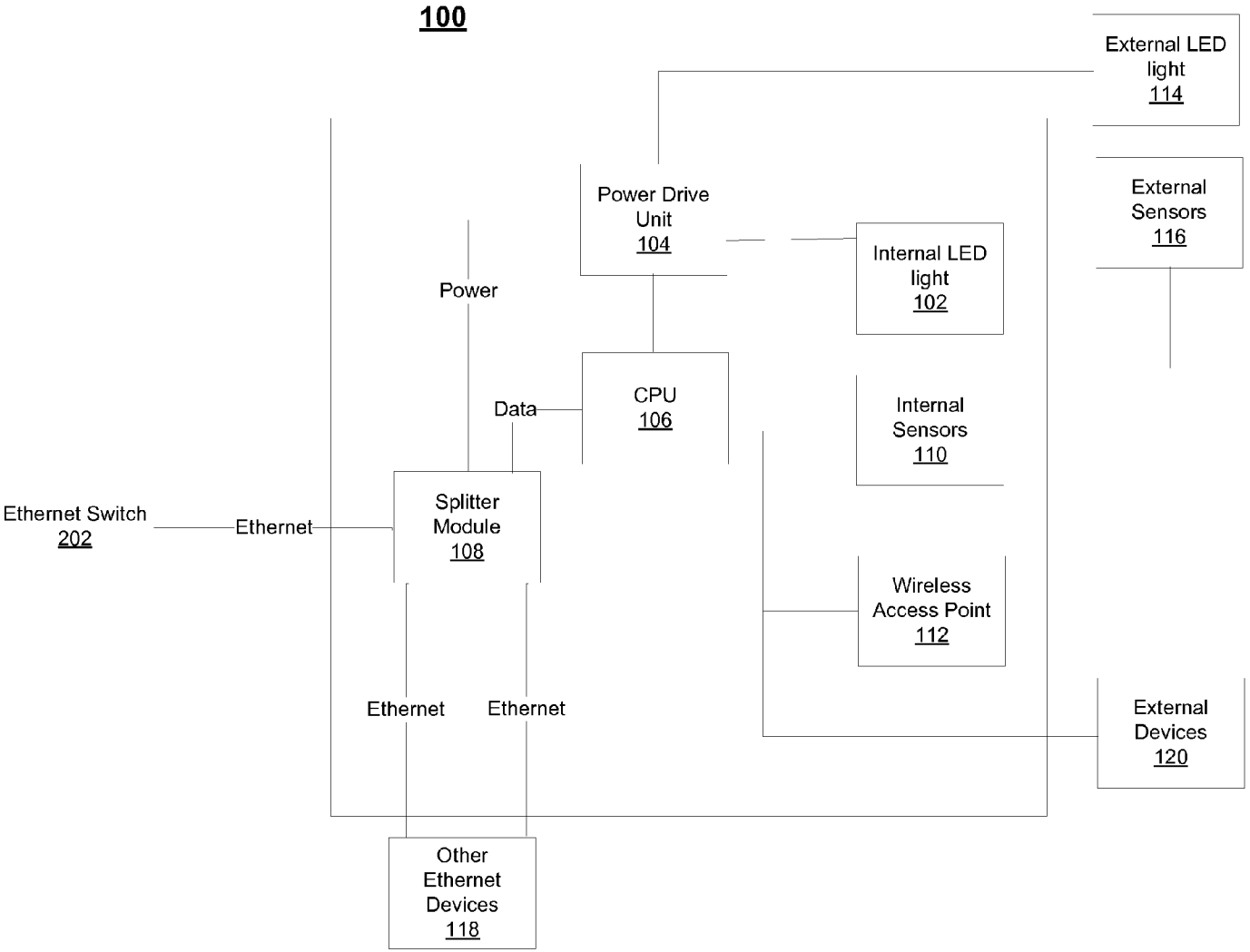
FIG. 1 is a block diagram of an exemplary light control structure.

FIG. 1 is a block diagram showing an exemplary light control structure 100 (also referred to as a light control module) that may be connected to an Ethernet cable. The light control structure 100 may optionally comprise a power drive unit 104, a central processing unit (CPU) 106, a splitter module 108, an internal LED light 102, and other components. While one internal LED light 102 is depicted in FIG. 1, any number of internal LED lights may be optionally affixed to the light control structure 100. One or more external lights 114 may also be utilized in the system and controlled by the light control structure 100. The external lights 114 may be used in conjunction with, or in place of, internal lights 102. The LED lights 102, 114 may be any type of standard LED light commercially available. Each LED light 102, 114 may comprise one or more individual lights.

Typically LED lights range from 1 watt to 25 watts (corresponding to the light output of incandescent bulbs of many times this wattage). While LED lights are discussed in exemplary embodiments herein, any other type of light may be used alternately, or in conjunction with, an LED light. For example, the light control structure 100 may be used with a halogen light, or any other type of light.

The Ethernet cable connected to the light control structure 100 may be used to both provide power to the power drive unit 104 and other components, as well as transmit data packets to the CPU 106 and other components of the light control structure 100. The power drive unit 104 may be comprised of power drive circuitry that enables the control of LED light 102.

The CPU 106 may direct the power drive unit 104 to turn one or more of the LED lights 102, 114 on and off, adjust the intensity or hue of the lighting, or any other type of control of light characteristics. The CPU 106 may further optionally be in communication with one or more internal sensors 110, external sensors 116, wireless access point 112, and any number of other external devices 120. Though the CPU 106 is only shown to be connected to these components in FIG. 1, the CPU 106 may also be connected to any number of other components or devices, such that it may direct these components to take a particular action. The internal sensors 110 and external sensors 116 may be passive or active. The sensors 110, 116 may measure various parameters and simply report those parameters to the CPU 106, or may have their own computing unit that directs the CPU 106 to take a particular action based on the reading from one or more of the sensors 110, 116.

The CPU 106 enables the light control structure 100 to effectively function as its own computer, and thereby manage and control the lighting system in all or part of the building. The CPU 106 may be a one-chip microcontroller, and may further comprise one or more analog-to-digital converters, one or more digital-to-analog converters, a real-time clock, and other components. The CPU 106 on the light control structure 100 may be an autonomous part of a distributed management system. For instance, it may locally implement dimming of the individual lights that are controlled by it based on various parameters such as time-of-day, without relying on a central controller. Furthermore, direct control of the LED light 102 allows for dimming of individual lights to be carefully controlled (unlike retrofits into existing AC dimmer systems).

The light control structure 100 may further have its own network address, for example an Internet Protocol (IP) address, such that it may be connected to a communications network and be a discoverable device on the network. In exemplary embodiments, the light control structure 100 may be connected to a network within a house or building. The network may be any type of wired network, including a Local Area Network (LAN), and others. The system described herein may be implemented on a Layer 2 network, though other networks are also possible. The network may also be any type of wireless communications network, including WiFi, Bluetooth, ZigBee, and others.

Light control structures 100 may be placed throughout a building that is wired with Ethernet cable. In exemplary embodiments, the Ethernet cable may be of category 5, category 6, category 7, or variations thereof. The light control structure 100 may optionally also contain a splitter module 108, sometimes referred to as a repeater module, to allow multiple light control structures to be deployed in a fan-out or daisy-chain configuration, subject to total power distribution limits on a single PoE switch port. This avoids the requirement for home-run star wiring back to a central hub for every light control structure. The splitter module 108 may also divide an incoming Ethernet connection such that it may provide power to the power drive unit 104, and transmit data to the CPU 106. In various embodiments, the splitter module 108 may also allow for multiple Ethernet connections to be accessible to other Ethernet devices 118 from the Ethernet connection. Other Ethernet devices 118 that may be connected to the splitter module 108 may comprise any number of devices such as power over Ethernet surveillance cameras or a wireless access point. The other Ethernet devices 118 may use the Ethernet connection from the splitter to derive power for operation, or for communication only, or for both power and communication.

The external devices 120 may also be used by the light control structure 100 to control other functions in addition to lighting such as mini blinds in a building, a space heater, a heated towel rail, a bathroom fan, or any other type of device. Additionally, other external devices 120 may comprise devices of different output formats, for example, RS232, 485, DMX512, Dali and 0-10v, thus allowing the system to integrate with additional types of devices.

Figure 2:
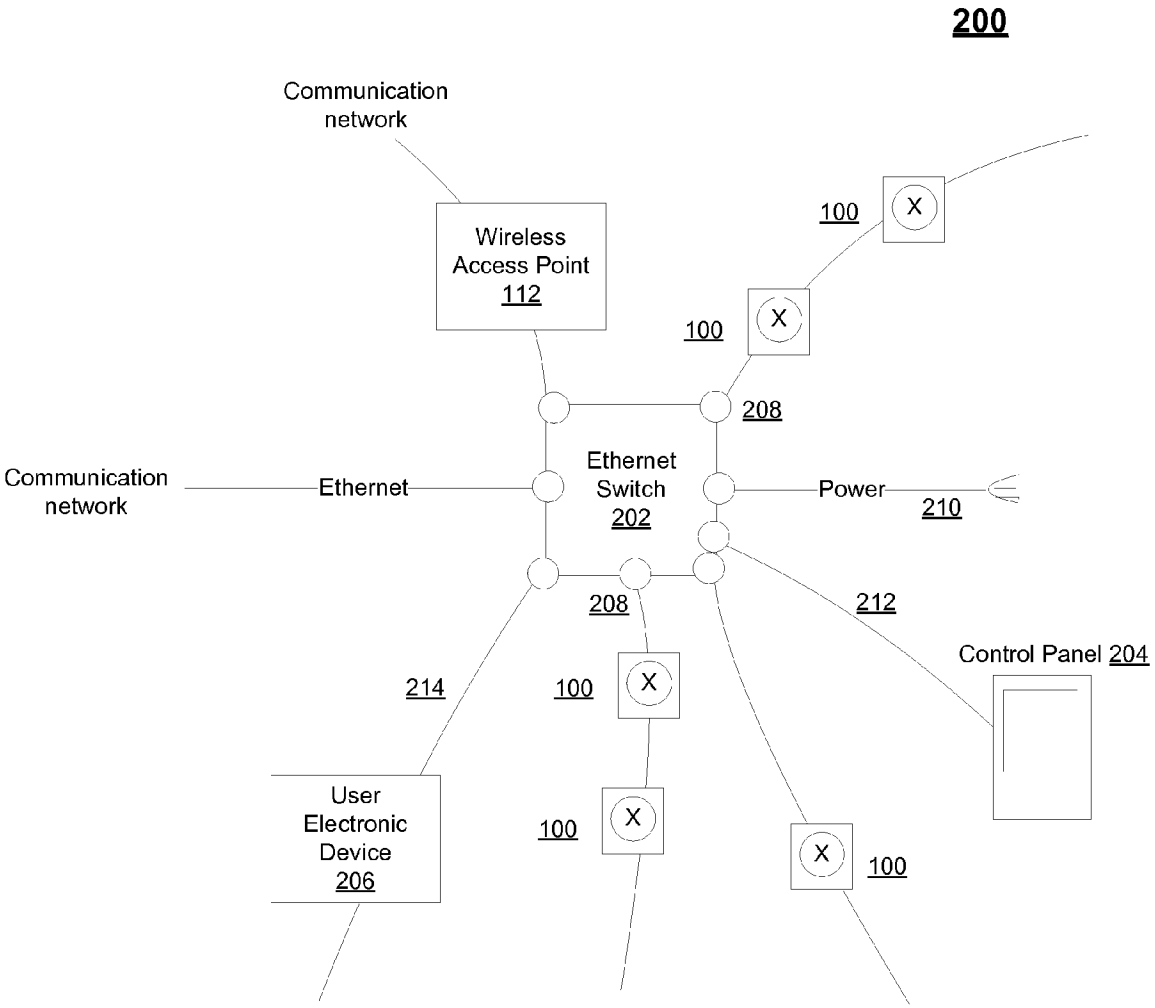
FIG. 2 illustrates exemplary components connected to a communications network.

FIG. 2 represents an exemplary diagram of components of a network 200 that may be employed in a building in conjunction with a light control structure 100. An Ethernet switch 202 may be used as a hub to connect and power devices using power over Ethernet. The Ethernet switch 202 may include integrated power over Ethernet capability, or a standard Ethernet switch may be used in combination with power over Ethernet injectors (as described by industry adopted power over Ethernet standards). Due to the low voltage nature of power over Ethernet cables, a house may be wired with Ethernet cable throughout, and thus be able to have lighting structures throughout the house without the need for a licensed electrician to install electrical wiring. In one embodiment, an Ethernet switch 202 may be connected through an electrical socket to a main power source in a building through cable 210. In another embodiment, the Ethernet switch 202 may be powered by a battery. Furthermore, the Ethernet switch 202 may be connected to a solar power source, or any other type of renewable energy source that may be present in the building. In some cases power from these various sources may be injected using external power over Ethernet injectors rather than being used to power the switch itself.

Due to the highly efficient nature of LED lights, multiple LED light control structures 100 may be powered from a single Ethernet port on the Ethernet switch 202. As shown on port 208 in FIG. 2, multiple LED light control structures 100 may be powered from a single Ethernet port in a daisy chain configuration. Each light control structure 100 may have its own network address and be independently discoverable on a communications network within a building. Furthermore, other system elements such as the Ethernet switch 202 and a control panel 204 may also have their own network addresses. The Ethernet switch 202 may facilitate the distribution of power throughout the system and facilitate communications between the various components. In exemplary embodiments, the Ethernet switch 202 does not individually control the brightness level of any light, rather the Ethernet switch 202 provides power and communications to the light control structure 100 which in turn controls the brightness level of component lights.

In exemplary embodiments, the Ethernet switch 202 may be connected to one or more wireless access points 112 located in the network 200, such that other wireless devices within the network 200 may be able to communicate with the Ethernet switch 202 and connected devices without having to directly connect to it through an Ethernet cable. It should also be apparent to those of ordinary skill in the art that a system could contain multiple Ethernet switches 202, configured to provide network communications between all the system devices within a building or buildings. In exemplary embodiments, the wireless access point 112 may be a component with the Ethernet switch 202, or external to the Ethernet switch 202.

Other system elements, such as a user electronic device 206 may also be connected to the Ethernet switch 202 through a wired Ethernet cable 214, or through one of the wireless access points 112. The wireless connection may be made to an access point 112 which is internal to a light structure, or via a separate component connected either directly or indirectly to the Ethernet switch 202. A user electronic device 206 may be a personal computer, laptop computer, tablet, smartphone, gaming device, personal digital assistant, or any other type of electronic device.

The user electronic device 206 may further be used to access a management system through a software application. The management system may be used to control the distributed system of the LED light structures throughout the building. The software application for the management system may be accessed through a user electronic device 206. In one embodiment, the user electronic device 206 is a portable handheld device such as a tablet or smartphone.

The management system may be implemented as a distributed system compromising a software component deployed on the user electronic device 206, in communication with software components deployed in the light control structures 100 or other system elements. In various embodiments, data from the management system may be stored in one or more of a database deployed on the user electronic device 206, server or other computing device, or in a cloud-based remote data storage location. With data from the management system stored in a cloud-based remote data storage location, a user may remotely access the management system from a different user electronic device 206 at different times. The management system may be distributed such that no central controller is required.

A discovery protocol may be implemented by the management system to transmit data packets throughout the communications network to discover all or a subset of the light control structures 100 and the lights that they control, Ethernet switches, wireless access points, user electronic devices, control panels, and any other component with a network address in the network. For example, through the software, a user may be able to determine which LED light fixtures exist by transmitting data packets throughout the network and receiving responses from each of the network components. The software may also enable a user to control a particular light control structure 100 or group of light control structures by turning LED lights 102 on or off, dimming them, adjusting the intensity of hue, or any other type of lighting control.

The software may further modulate the lights such that they flicker on and off very quickly. The flickering may be too quick for the human eye to detect, but may be detectable by a light sensor that may be associated with a handheld user electronic device. This is possible because LEDs have a faster response time than incandescent lights. In exemplary embodiments, a built-in camera on a user electronic device 206 may be used as a sensor. A user may initiate a modulation pattern through the management system accessed by the user electronic device 206. Each LED light 102, or group of lights, may then be modulated with a unique pattern. A user may carry the handheld user electronic device 206 with the light sensor throughout each room in the building or house, and the light sensor may then be able to determine which lights are controlled by which light control structure and where they are located in the building. This may allow the user to determine which light in which room corresponds to which network address without needing to look up a construction plan or wiring diagram of the building. In some embodiments, the LED lights and/or light sensor may not permit modulation at frequencies higher than what the human eye can detect. In these embodiments, the LED light 102 or group of lights may be modulated more slowly. Slower modulation patterns may also be employed to help the user identify and assign an identifier, such as a name, number, symbol, or any combination thereof, for a particular light in the management system. An exemplary method for programming a light is discussed further in association with FIG. 6 below.

Figure 3:
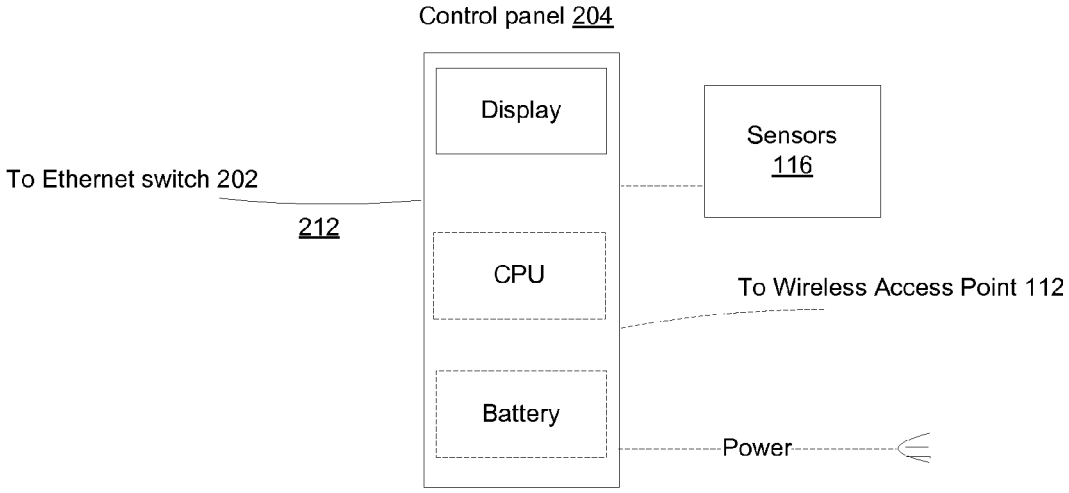
FIG. 3 illustrates an exemplary control panel.

In a further embodiment, a control panel 204, such as that illustrated in FIG. 3 may be utilized to discover and control LED light control structures in various parts of the building. A user may not always have a user electronic device 206 readily available, and thus may wish to access the management system through a physical control panel. The control panel 204 may be located at any place in the building, and may be connected to the Ethernet switch 202 through cable 212, or wirelessly connect to one of the wireless access points 112. The control panel 204 may be powered by a battery, power over Ethernet, or by plugging into the main electrical system for the building. There may also be multiple control panels placed throughout a building, such as one in every designated region like a room or hallway. The control panel 204 may have a display that may comprise a touch screen, liquid crystal display (LCD), plasma, or any other type of display. The control panel 204 may further comprise one or more manual buttons in conjunction with the display that may be depressed by the user to adjust settings via the control panel 204. In some embodiments, a user may also access the management system through a software application on the control panel 204. Furthermore, a control panel 204 may be designated for a particular region of a building, set of LED lights, or individual LED lights. A user may also change the particular controlled region or lights for the control panel 204 through the management system software.

The control panel 204 may also have its own network address and may also have additional components connected to it. In various embodiments, the control panel 204 may additionally serve as a wireless access point 112 for the communication network. The control panel 204 may act as its own computer, and optionally have sensors 116 connected to it. While there may be sensors 116 connected to the light control structure 100, in various embodiments, the control panel 204 may be connected to sensors 116 in addition to the light control structure 100, or instead of the light control structure 100. The control panel 204 may also have internal sensors 110.

The sensors 116 may comprise one or more of a detection device to measure the ambient temperature of an area, brightness of an area, smoke detector, carbon monoxide detector, motion sensor, occupancy sensor, clock, calendar, camera, or any other type of sensor. In various embodiments, it may be advantageous to place a carbon monoxide detector, for example, closer to the eye level of a person, rather than near a light control structure 100 placed near a ceiling of a room. In other embodiments, an occupancy sensor may be connected to a light control structure 100 in a room where there is no control panel 204.

In various embodiments, a sensor 116 may be used to measure the ambient brightness of an area. In these embodiments, when the ambient brightness of a room drops below a certain level, the sensor 116 may automatically send a signal to the CPU 106 of the light control structure 100, which may then send a signal to the power drive unit 104 to turn on one or more LED light 102. In exemplary embodiments, the power drive unit 104 may direct the LED light 102 to either turn on at full intensity, or may direct the LED light 102 to turn on at a specific intensity needed to bring the brightness of the area to a set level. The desired level of brightness to be maintained in an area may be predetermined, or may be adjustable by a user through the management system. As the sun sets and an area gets darker, the intensity of the LED light 102 may be continually increased to maintain a desired brightness level for the area. Additionally, ambient color temperature may also be monitored by internal sensor 110 or external sensor 116. Ambient color temperature may detect daylight, sunset, sunrise, or any other similar scenario. Typically residential lighting is around 3000 kelvin (warm white) which may be desirable at night, whereas office lighting is typically closer to daylight at 4000-5000 kelvin (cool white), optimized for use during the day. A color temperature sensor in combination with controlled color temperature (also referred to as CCT) LED light may allow for optimization of the light color according to the outdoor lighting state.

The sensor 116 may collect data and readings and communicate the data to the CPU 106. The CPU 106 may then determine whether the readings are above or below a set threshold and direct a light control structure 100 accordingly.

The sensor 116 may also be a passive sensor such that it simply measures a particular parameter. The sensor 116 sends the data to the CPU 106 without signaling to the CPU 106 to take any particular action in response to the readings on the sensor 116.

In other embodiments, the CPU 106 may comprise a real-time clock, such that when a specific time of day is reached, the CPU 106 may direct one or more LED light 102 or light control structure 100 to take a certain action. The action may be directing the lights to turn on at a specific time, directing the lights to turn off at a specific time, or directing the lights to dim or adjust in intensity or hue based on a time of day, or day of the week.

The management system may also have an automatic lighting control mechanism, such as automatic dimming of the lights at certain times of day, or automatic turning on and off of lights at preset times. The sensors 116 may also utilize a motion sensor or occupancy sensor to automatically turn lights on or off when a person enters or exits an area, such as a room. Furthermore, a sensor 116 may comprise a camera, such as a security camera. In various embodiments, a security camera may begin recording when an LED light 102 that it is connected to turns on, and may cease recording when the LED light 102 turns off. Conversely the lighting may be adjusted in response to the security scenario, for example the light level may be increased when an anomalous event is detected by the camera.

Figure 4:
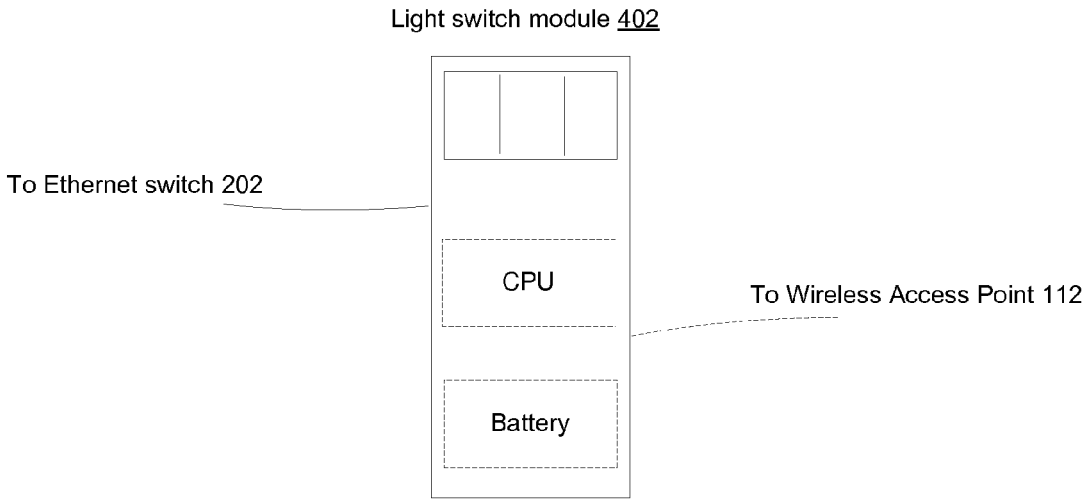
FIG. 4 illustrates an exemplary light switch module.

The communications network of FIG. 2 may further be connected to a light switch module. FIG. 4 depicts an exemplary light switch module 402. The light switch module 402 may be comprised of buttons to depress to activate the lights. The light switch module 402 may be used to control a particular light control structure 100 or set of LED lights 102 located in an area of a building. In this way, an LED light 102 may be turned on or off by simply depressing a button on the light switch module 402. The light switch module 402 may also be connected to the Ethernet switch 202 through a wired Ethernet cable. The light switch module 402 may also be a device discoverable on the network and have its own network address. The light switch module 402 may have an identifier in addition to a network address that may be predetermined, or set by a user, such as a name or number associated with its location. A user may access and program the identifier for the light switch module 402 by pointing a user electronic device 206 at it. In other embodiments, a user may be able to press one or more buttons on the light switch module 402, which may then signal to the management system that the user wishes to program a parameter for the light switch module 402.

In further embodiments, the light switch module 402 may be connected to one of the wireless access points 112. The light switch module 402 may have a CPU and battery. The CPU may include software which is a derivative of the parent software running on the light control structure 100 and capable of many of the same control features as the parent software. When running on the battery, the light switch module 402 may be placed anywhere in the building, since it does not need to be plugged into the electrical wiring system of the building. When embodied in battery powered mode, the light switch module 402 may be affixed to the wall in a non-destructive manner, such as a light adhesive tape. In this way the light switch module 402 may be moved as needs change without any need to rewire. In other embodiments, light switch module 402 may be powered through a cable connected to the electrical wiring of the building or by a power over Ethernet cable.

The management system may further be used to program the CPU of the light switch module 402 to correlate to a particular light or set of lights. The CPU of the light switch module 402 may also be re-programmed at any time so that the light switch module 402 is correlated to a different set of lights if the switch is moved to a different location, or lights are added or removed later. The light switch module 402 may further be programmed to control the lights in additional ways, such as dimming, changing color, or any other type of lighting control. The distributed management system would permit the light switch module CPU to direct messages to any of the light control structures 100 in the system. One method by which the management system may correlate a particular light switch module 402 with a desired user action is to ask the user to press one or multiple buttons on the targeted light switch module 402 simultaneously. This event would be transmitted by the light switch module 402 to other components of the distributed management system, which could then instruct the light switch module 402 to perform particular actions in the future, such as transmit button press events to particular light control structures 100.

Figure 5:
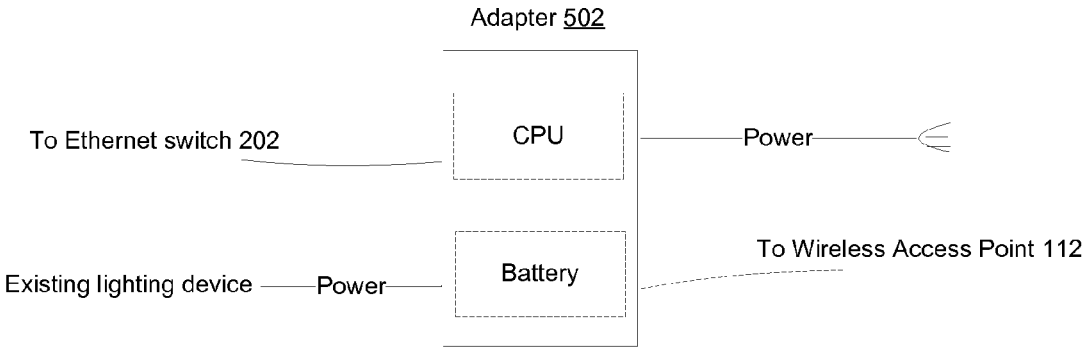
FIG. 5 illustrates an exemplary adapter.

FIG. 5 represents an exemplary adapter 502 that may be used to integrate the LED lighting system with an existing lighting system in the building that may utilize incandescent bulbs, fluorescent bulbs, or any other type of light. The adapter 502 may be powered through an electrical wire that plugs into the main electrical system for the building, or may optionally be powered through a battery. The adapter 502 may further have a CPU and be in communication with the management system of the building through an Ethernet cable connected to the Ethernet switch 202, through the wireless access point 112, or through communications over the power line itself.

The adapter 502 may have an input that allows a user to plug in an existing lighting device, such as a lamp, into one end, and be controlled by the management system for the LED lighting system for the building. Thus, even though the existing lighting device will not have a network address, the adapter 502 may have a network address, enabling it to be discoverable and controllable through the management system for the lighting system in the rest of the building. Through the adapter 502, the non-LED light source may also be discoverable and controlled through the management system of the LED lighting system deployed in other areas of the building. In some embodiments the CPU on the adapter 502 might run software that is a derivative of the light control structure software and be capable of many of the same functions.

Figure 6:
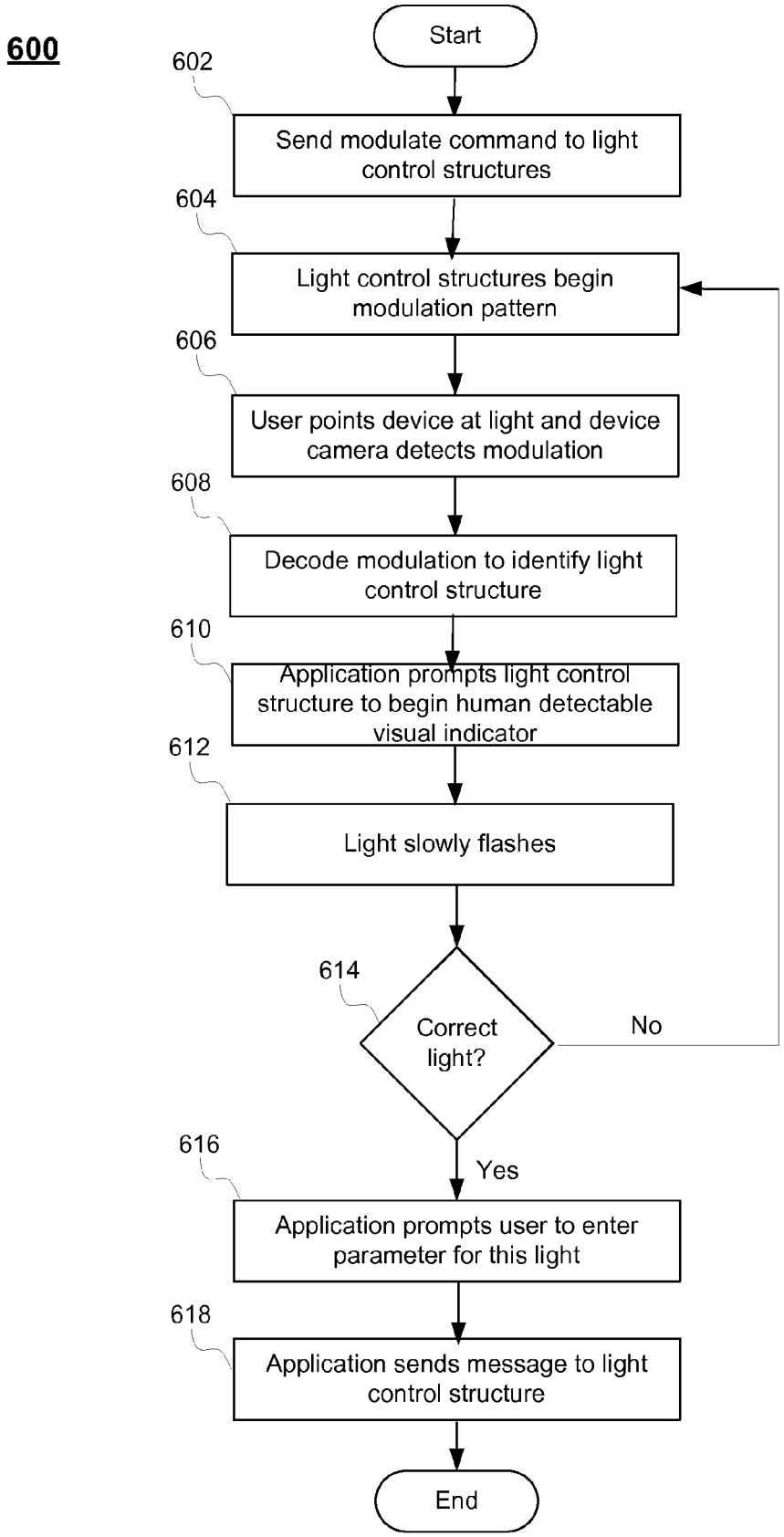
FIG. 6 illustrates an exemplary method for a light program sequence

FIG. 6 is a flowchart depicting an exemplary method for a light program sequence. The method 600 may be performed by a user electronic device 206, or any other device in communication with the management system. Additionally, steps of the method 600 may be performed in varying orders or concurrently. Furthermore, various steps may be added, subtracted, or combined in the method 600 and still fall within the scope of the present disclosure.

In step 602, a user begins programming a light by initiating a modulate command to the various light structures connected to the management system. A user may access the management system through a software application on a user electronic device 206, and direct the management system to broadcast a command to the various connected lights on the network to begin modulating, flashing, pulsing, or flickering at a specific speed or pattern. In addition to intensity modulation, the system might employ other techniques such as modulating the hue of the lights. In step 604, one or more light control structures begin the modulation pattern. The user then points their user electronic device 206 at a light that the user wishes to program. The user electronic device 206 may have a built-in camera that may then detect that the light is modulating in step 606. Because each light structure in the building may use a different modulation pattern, the management software can identify which light structure is controlling the light the user wishes to program in step 608. In some embodiments, each light controlled by a light control structure may be modulated with a distinct pattern. In this way the user electronic device 206 can identify both the light structure controlling the light and which of the multiple lights that structure controls is being observed. The user may then direct through the application program that the light to be programmed begin a human detectable visual indicator, such as flashing slowly or in a modulation pattern recognizable to the human eye, in step 610.

In exemplary embodiments, the light may receive the signal and begin flashing slowly, in step 612. The application program may then confirm with the user in step 614 if this is the correct light that the user wishes to program. If so, then the application on the user electronic device 206 may prompt the user to enter one or more parameters for this light in step 616. The parameter may be any kind of identifier for a particular light (such as a name, number, symbol, or any combination thereof), or may be a parameter for when the light is to turn on, off, adjust brightness, color, or any type of lighting control or light characteristic. When the user finishes entering the one or more parameters, the application on the user electronic device 206 may then send a message to the light control structure 100 in step 618 to update its identifying information. The application may also send a message to update the management system with the new information. If the flashing light is not the correct light in step 614, then the light control structures may begin modulating again at step 604, and the steps repeated.

The method 600 may be used when a user is first programming and setting up the LED lighting system for the building, or to update one or more parameters of a light, such as changing its identifier, or any other type of lighting control. Furthermore, the method 600 may be used when a new light is installed into an existing building.

Figure 7:
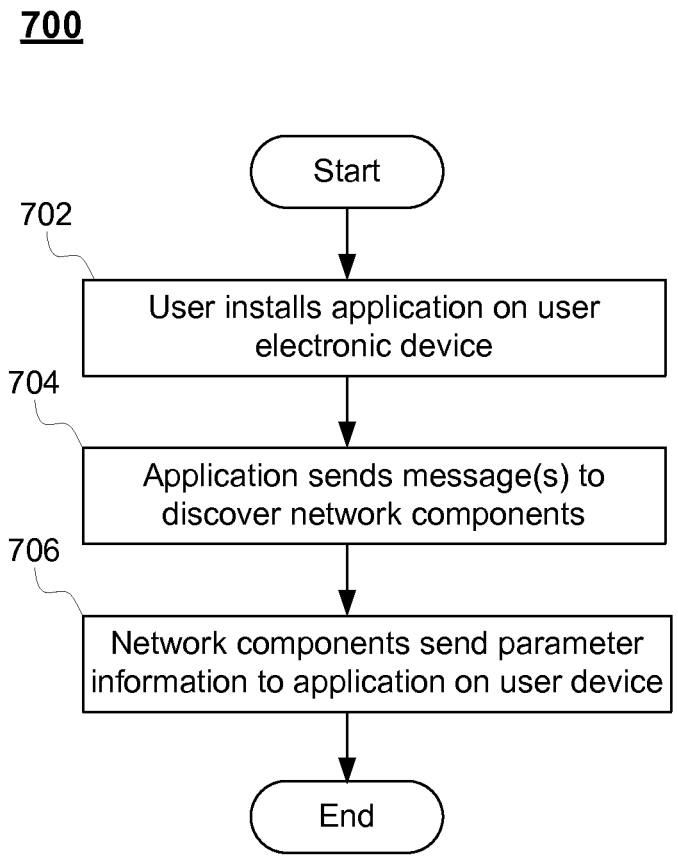
FIG. 7 illustrates an exemplary method for a sequence that may be deployed on a new user electronic device.

FIG. 7 is a flowchart depicting an exemplary method for a sequence that may be deployed on a new user electronic device 206. The method 700 may be performed by a user electronic device 206, or any other device in communication with the management system. Additionally, steps of the method 700 may be performed in varying orders or concurrently. Furthermore, various steps may be added, subtracted, or combined in the method 700 and still fall within the scope of the present disclosure.

In step 702, a user installs a control application on the user electronic device 206 that the user wishes to use to access the LED lighting control system (also referred to as the management system). In step 704, the application on the user electronic device 206 sends a discovery protocol, such as a broadcast or multicast message, throughout the communication network to discover the various devices or components on the network. Each of the network components returns a message to the application on the user device in step 706 that allows the application to determine which components are connected to the network, where they are located, and any other parameter information about the lighting control system setup (such as identifying names and any automatic lighting program sequences). In this way, the application on the user electronic device 206 may retrieve identifying information about the LED lighting control system in the building. In some embodiments access to control the system may be controlled by a password or other security method.

Figure 8:
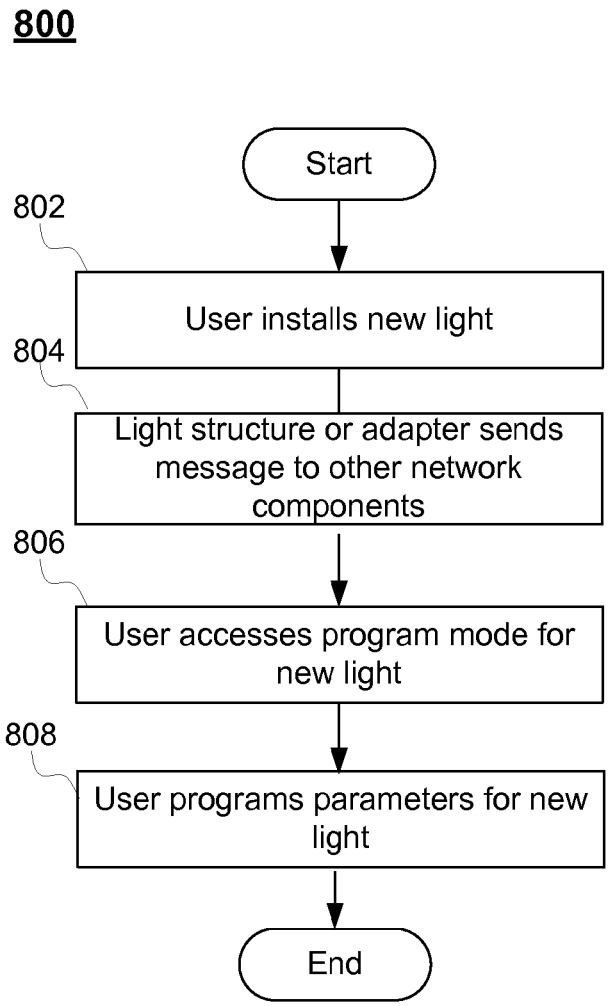
FIG. 8 illustrates an exemplary method for a sequence that may be deployed by a management system when a new lighting device is added.

FIG. 8 is a flowchart depicting an exemplary method for a sequence that may be deployed by a management system when a new lighting device is added. The method 800 may be performed by a computer, server, or any other computing device with software components of the management system. Additionally, steps of the method 800 may be performed in varying orders or concurrently. Furthermore, various steps may be added, subtracted, or combined in the method 800 and still fall within the scope of the present disclosure.

In step 802, a new light is added. The new light may comprise a new LED light 114, new light control structure 100, or a non-LED light such as a lamp. In an exemplary embodiment, once a new lamp is plugged into the main electrical system of a house with an adapter 502, the adapter 502 may then send one or more messages to announce itself in the communication network in step 804. A user may then access the program mode for the light through the management system in step 806, and program parameters for the light in step 808. In exemplary embodiments, if the lamp or other light is subsequently moved to a different area, it may need to be re-named or re-programmed if different parameters are required for the new location. Each light structure may save its own parameters in non-volatile memory, such that it can resume operation after a power failure.

Figure 9:
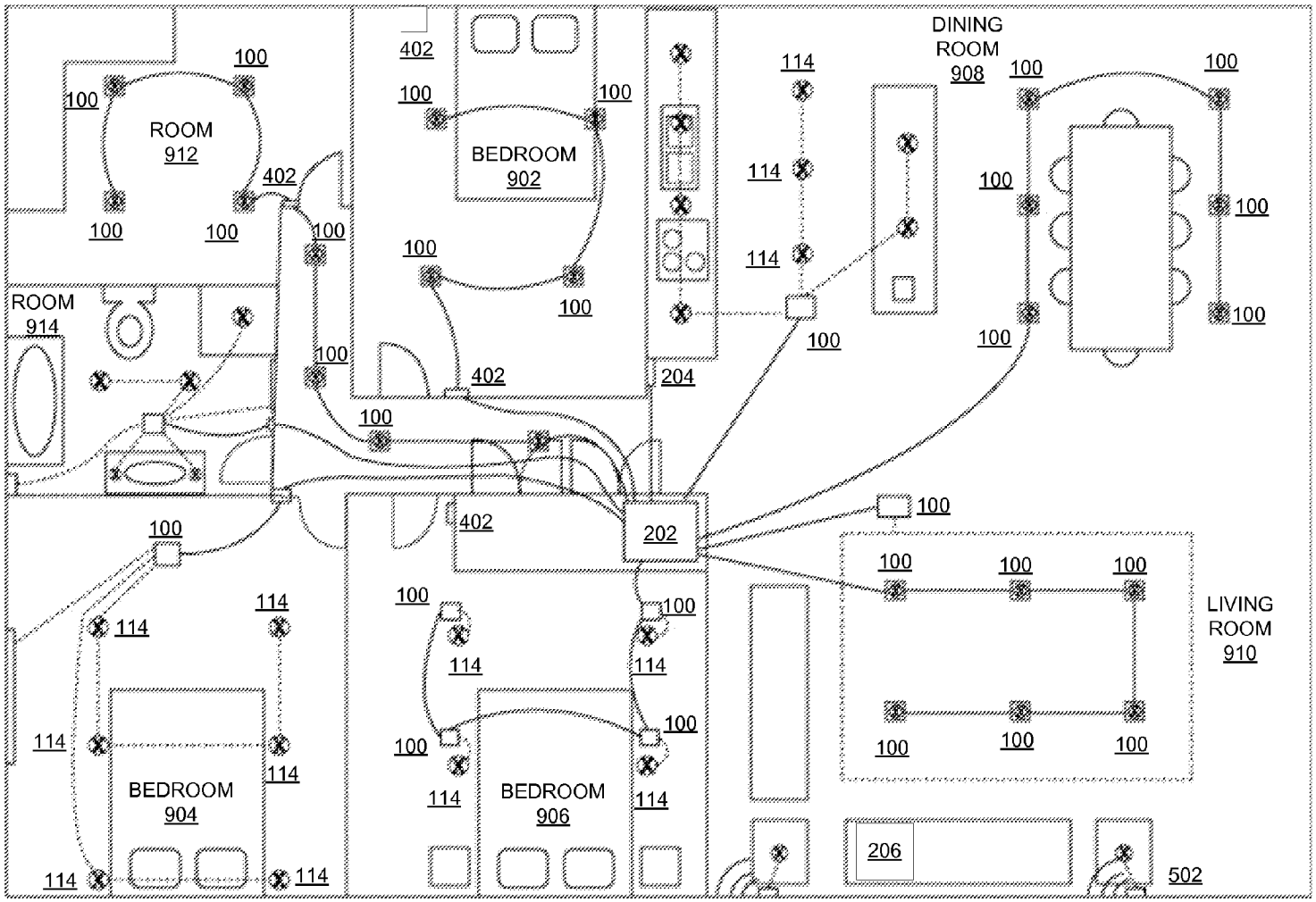
FIG. 9 is an exemplary representation of an LED lighting system controlled by a communications network and powered over Ethernet deployed throughout a house.

FIG. 9 is an exemplary representation of an LED lighting system controlled by a communications network and powered over Ethernet deployed throughout a house. In this exemplary embodiment 900, a central Ethernet switch 202, is located in bedroom 906. Also in bedroom 906 are four light control structures 100, each controlling an external LED light 114. Ethernet cabling carries control information and power to the light control structures 100, which then output DC power to the LED lights. A light switch module 402 is mounted by the entry door.

In bedroom 902, there is a light switch module 402 located next to the door, and four light control structures 100 with internal LED lights 102. Each of these are connected in a daisy chain configuration on the same Ethernet port. An additional wireless variation of the light switch module 402 is installed next to the bed. In exemplary embodiments, the light switch module 402 may also function as a control panel 204.

Room 912 adjacent to bedroom 902 also has light control structures 100 with internal LED lights 102 connected in a daisy chain configuration. Room 912 also has a light switch module 402, which may also function as a control panel 204. Room 914 and bedroom 904 each have one light control structure 100 capable of controlling multiple devices. In the case of bedroom 904, two outputs on light control structure 100 power six external LED fittings 114, and provide a control signal to open or close a window blind. Room 914 has four outputs to external LED fittings 114, as well as an output to an extraction fan, and control of a heated towel rail. An external humidity sensor 116 may also be used for automatic extractor fan activation at a preset level held by the CPU 106, as well as a schedule programmed for activation of the heated towel rail. Living Room 910 has multiple light control structures 100 with internal LED 102 connected in a daisy chain configuration. An additional light control structure 100 is used to provide output to RGB (Red, Green, Blue) light strip lighting housed in feature pelmet. Control over the intensity and color can be accessed from the nearby touchscreen control panel 204, or wirelessly from a user electronic device 206 such as an android tablet device. Two traditional incandescent table lamps are used, plugged in to a wall adapter 502, which is then plugged into a mains power outlet. The adapter 502 may communicate wirelessly with the network 200, and allow the lamps to be controlled via the light switch module 402 or user electronic device 206.

Dining Room 908 includes six light control structures 100 with internal LED 102, and a further light control structure 100, providing three outputs for nine external LED lights 114 (also referred to as LED fittings).

While the above described systems and methods have been described within a building, they may also be employed in any other type of building or structure. Although embodiments have been described with reference to specific example embodiments, it will be evident that various modifications and changes can be made to these example embodiments without departing from the broader spirit and scope of the present application. Therefore, these and other variations upon the exemplary embodiments are intended to be covered by the present invention. Accordingly, the specification and drawings are to be regarded in an illustrative rather than a restrictive sense.

What is claimed is:

1. A light control structure comprising:

a power drive unit that receives power through an Ethernet cable to power lights; and a processing unit in communication with the power drive unit, wherein the processing unit receives a command to modulate different ones of the lights using different modulation patterns, respectively, wherein the different modulation patterns distinguish between the different lights.

2. The light control structure of claim 1, further comprising:

a splitter module that provides at least one of power and data connectivity to a plurality of other devices.

3. The light control structure of claim 1, further comprising:

a wireless access point in communication with the processing unit through a communications network.

4. The light control structure of claim 1, further comprising:

one or more sensors in communication with the processing unit.

5. The light control structure of claim 4, wherein the one or more sensors comprise at least one of a thermometer, carbon monoxide detector, motion sensor, occupancy sensor, and camera.

6. The light control structure of claim 4, wherein the one or more sensors in communication with the processing unit are contained within the light control structure.

7. The light control structure of claim 4, wherein the one or more sensors in communication with the processing unit are external to the light control structure.

8. The light control structure of claim 1, wherein the lights are contained within the light control structure.

9. The light control structure of claim 1, wherein the lights are external to the light control structure.

10. The light control structure of claim 1, wherein the light control structure has a network address and is a discoverable component on a communications network.

11. The light control structure of claim 10, wherein the network address is an IP address.

12. The light control structure of claim 1, wherein the light control structure is further in communication with at least one of an Ethernet switch, light switch module, control panel, and user electronic device.

13. The light control structure of claim 1, further in communication with a programmable light switch module such that an input to the light switch module indicates to the light control structure to change the light characteristics of the lights.

14. The light control structure of claim 1, wherein the lights are LED lights.

15. The light control structure of claim 1, wherein the processing unit of the light control structure is further configured to control the light characteristics of the lights by at least one of: adjusting the intensity, power, or hue of the lights.

16. The light control structure of claim 1, wherein the processing unit further comprises a software program for directing the lights to illuminate according to a scheduled program.

17. The light control structure of claim 1, wherein the processing unit further comprises:

a software program to facilitate the control of the light control structure, the software program accessible by a user through an application on a user electronic device.

18. The light control structure of claim 1, wherein the processing unit further comprises:

a software program to facilitate the control of the light control structure, the software program accessible by a user through a control panel.

19. The light control structure of claim 1, wherein the light control structure has an identifier designated by a user.

20. The light control structure of claim 19, wherein the identifier designated by the user is at least one of a name, number, symbol, or a combination thereof.

* * * * *